US006845803B1

(12) United States Patent
Nien

(10) Patent No.: US 6,845,803 B1
(45) Date of Patent: Jan. 25, 2005

(54) CORD MEMBER SAFETY CONNECTOR FOR WINDOW BLIND

(75) Inventor: Ming Nien, Changhua Hsien (TW)

(73) Assignee: Nien Made Enterprise Co., LTD, Taichung (TW)

( * ) Notice: Subject to any disclaimer, the term of this patent is extended or adjusted under 35 U.S.C. 154(b) by 0 days.

(21) Appl. No.: 10/683,696

(22) Filed: Oct. 14, 2003

(30) Foreign Application Priority Data

Jul. 30, 2003 (TW) ..... 92213876 U

(51) Int. Cl.[7] ..... E06B 9/38
(52) U.S. Cl. ..... 160/178.1 R; 160/243
(58) Field of Search ..... 160/178.1 R, 173 R, 160/168.1 R, 176.1 R, 84.01, 84.04, 243; 24/115 F

(56) References Cited

U.S. PATENT DOCUMENTS 4,857,516 A * 8/1989 Terao et al. ..... 514/100
5,485,875 A * 1/1996 Genova ..... 160/168.1 R
5,542,461 A * 8/1996 Huang ..... 160/178.1 R
5,560,414 A * 10/1996 Judkins et al. ..... 160/178.1 R
5,919,542 A * 7/1999 Chou ..... 428/99
5,971,054 A * 10/1999 Gobidas ..... 160/178.1 R
6,044,523 A * 4/2000 Ortega ..... 16/442
6,263,946 B1 * 7/2001 Cotten ..... 160/178.1 R
6,431,248 B1 * 8/2002 Hyman et al. ..... 160/178.1 R
6,640,870 B2 * 11/2003 Osinga ..... 160/178.1 R
6,644,379 B1 * 11/2003 Nei ..... 160/243

* cited by examiner

*Primary Examiner*—David Purol
(74) *Attorney, Agent, or Firm*—Browdy and Neimark, P.L.L.C.

(57) ABSTRACT

A connector for connecting a cord member of a window blind includes a supporting member and a coupling member detachably coupled to the supporting member. The supporting member has a receiving space and an escape opening that is communicated with the receiving space and has a diameter smaller than that of the receiving space. The coupling member has a compressible retaining portion received in the receiving space and stopped above the escape opening, and a cord member tie portion for connection of the cord member. When the cord member is pulled by an external force over a predetermined level, the retaining portion is allowed to pass through the escape opening.

10 Claims, 5 Drawing Sheets

CORD MEMBER SAFETY CONNECTOR FOR WINDOW BLIND

BACKGROUND OF THE INVENTION

1. Field of the Invention

The present invention relates generally to a window blind and, more specifically, to a cord member safety connector used in a window blind, which will be self-unconnected from the window blind when the cord member receives an exceeding load.

2. Description of the Related Art

A variety of window coverings including Venetian blinds, roller blinds, etc. are known. These window coverings commonly comprise a headrail, a bottom rail, a blind body coupled between the headrail and the bottom rail, a lifting mechanism controlled to lift the bottom rail to the desired elevation to further change the shading status of the window covering. The lifting mechanism comprises a plurality of pull cords for operation by the user to adjust the elevation or shading status of the window covering.

In the aforesaid window coverings, the pull cords are exposed to the outside and accessible to children. An accident may happen when a child playing with the cord members for fun. FIG. 1 shows a conventional roller blind, which comprises a headrail 1, a bottom rail 2, a blind body 3 coupled between the headrail 1 and the bottom rail 2, and a lifting mechanism 4 adapted to control the lifting and positioning of the bottom rail 2 to change the shading status of the blind body 3. The lifting mechanism 4 comprises two lift cord sets 5, two lift cord brackets 6 at the back side of the headrail 2, and a lift lock 7. The lift cord sets 5 each have a respective rear cord section 5*a* respectively fastened to the lift cord brackets 6 and then extended downwards over the bottom side of the bottom rail 2, a respective front section 5*b* extended upwards to the inside of the headrail 1 and then inserted through the lift lock 7, and a respective operation section 5*c* extended out of the headrail 1 for operation by the user. The rear section 5*a* and front section 5*b* of each cord member of the lift cord set 5 form an enclosed loop 5*d*. This enclosed loop 5*d* may be tangled and hung on the retaining portion of the child who plays with the lift cord sets 5 for fun.

Therefore, it is desirable to provide a cord member safety connector that eliminates the aforesaid problem.

SUMMARY OF THE INVENTION

It is the main object of the present invention to provide a cord member safety connector, which automatically disconnects the cord member from the window blind when the cord member received a stretching force surpassed a predetermined level.

To achieve this object of the present invention, the connector for connecting a cord member of a window blind includes a supporting member and a coupling member detachably coupled to the supporting member. The supporting member has a receiving space and an escape opening that is communicated with the receiving space and has a diameter smaller than that of the receiving space. The coupling member has a retaining portion received in the receiving space and stopped above the escape opening, and a cord member tie portion for connection of the cord member. When the cord member is pulled by an external force over a predetermined level, the retaining portion is allowed to pass through the escape opening such that the coupling member is detached from the supporting member.

DETAILED DESCRIPTION OF THE INVENTION

Figure 1:
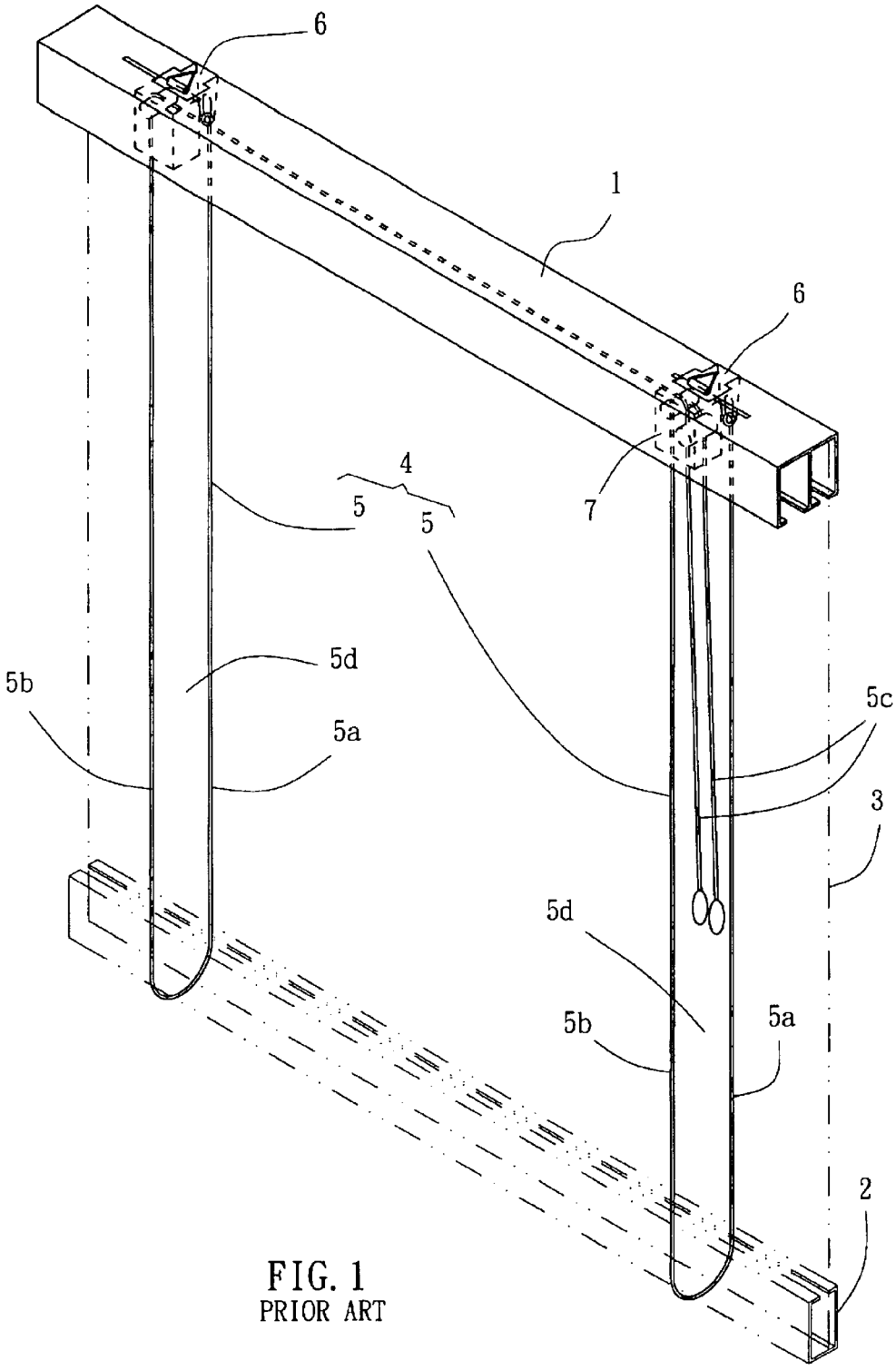
FIG. 1 PRIOR ART
FIG. 1 is a perspective view of a window blind according to the prior art.
Figure 2:
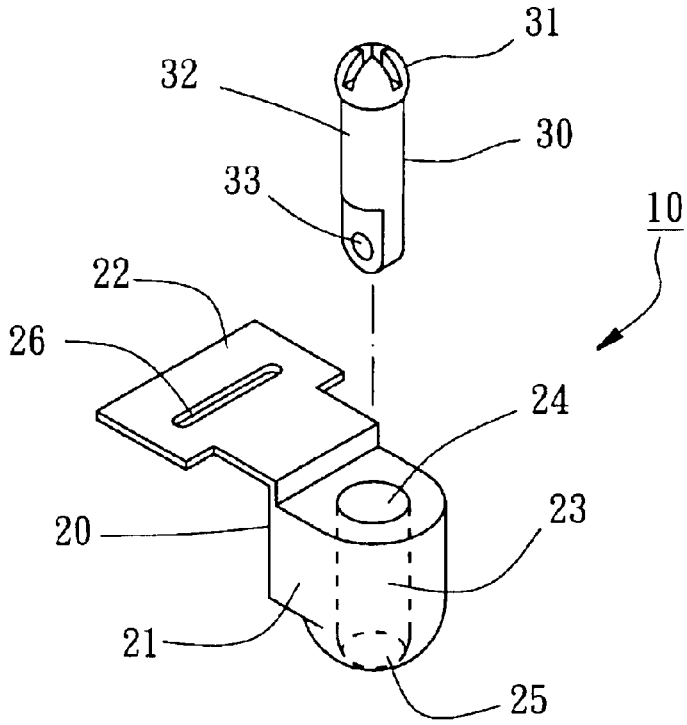
FIG. 2 is an exploded view of a cord member safety connector according to a first preferred embodiment of the present invention.

Referring to FIG. 2, a cord member safety connector 10 in accordance with the first preferred embodiment of the present invention is shown comprised of a supporting member 20 and a coupling member 30. The supporting member 20 is molded from plastics or elastic material, comprising a solid base 21 and a flat mounting portion, i.e. mounting flange 22, perpendicularly extended from the periphery of the top side of the solid base 21. The solid base 21 has a coupling portion 23 having a receiving space, e.g. a cylindrical through hole 24, which extends through the top and bottom sides of the solid base 21. The cylindrical through hole 24 has a reduced bottom end 25 of relatively smaller diameter, forming an escape opening of the coupling portion. The flat mounting flange 22 has an elongated slot 26. The coupling member 30 is a cylindrical rod member having a body portion 32, a radially compressible retaining portion, namely, the expanded top split head 31 at one end of the body portion 32 (the top split head 31 is a round head having a plurality of radial splits), and a cord member tie portion formed of a tie hole 33 at the other end of the body portion 32 for the connection of a cord member. The body portion 32 has a diameter slightly smaller than the reduced bottom end 25 of the cylindrical through hole 24. The top split head 31 is radially compressible, having a diameter slightly smaller than the cylindrical through hole 24 of the coupling portion 23 but slightly greater than the reduced bottom end 25 of the cylindrical through hole 23.

Figure 3:
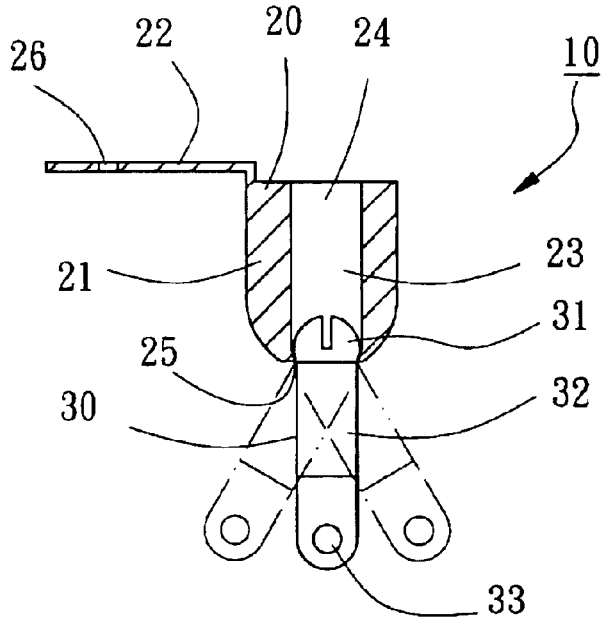
FIG. 3 is a schematic sectional view of the cord member safety connector according to the first preferred embodiment of the present invention.

The connection between the supporting member 20 and the coupling member 30 is outlined hereinafter with reference to FIG. 3. The coupling member 30 is downwardly inserted into the coupling portion 23 of the supporting member 20 from the top side, keeping the expanded top split head 31 of the coupling member 30 stopped at the reduced bottom end 25 of the cylindrical through hole 24 of the coupling portion 23 of the supporting member 20. At this time, the coupling member 30 can be rotated in the coupling portion 23 of the supporting member 20. When the tie hole 33 of the coupling member 30 is receiving an external force that pulls the coupling member 30 outwards from the coupling portion 23 of the supporting member 20, the expanded top split head 31 is forced against the peripheral wall of the reduced bottom end 25 of the cylindrical through hole 24 of the coupling portion 23 of the supporting member 20 and radially inwardly compressed to reduce its outer diameter and the reduced bottom end 25 is pressed to slightly expend its diameter. If the external force is continuously increased, the expanded top split head 31 will be compressed to such an extent that the diameter of the compressed top split head 31 becomes smaller than the diameter of the reduced bottom end 25 of the cylindrical through hole 24, for enabling the coupling member 30 to be disconnected from the supporting member 20.

Figure 4:
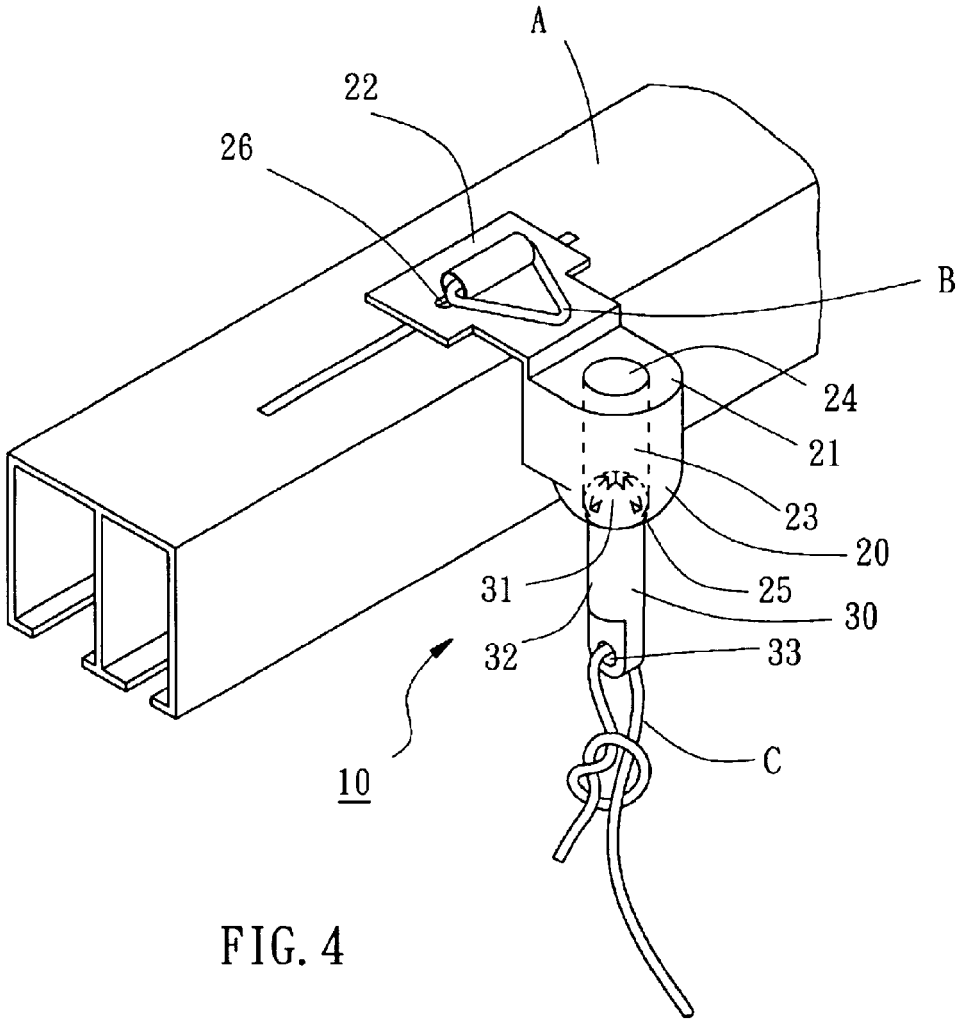
FIG. 4 is a perspective view showing the cord member safety connector of the first preferred embodiment of the present invention installed in a headrail of a window blind.

Referring to FIG. 4, the elongated slot 26 of the flat mounting flange 22 of the supporting member 20 is fastened to the headrail A of a window blind (not shown) with a hanger B, and a cord member C is fastened to the tie hole 33 at the bottom end of the body portion 32 of the coupling member 30 after insertion of the coupling member 30 into the cylindrical through hole 24 of the coupling portion 23 of the supporting member 20. On design, the friction force F between the top split head 31 of the coupling member 30 and the reduced bottom end 25 of the cylindrical through hole 24 of the coupling portion 23 of the supporting member 20 must surpass the load of window blind W so that the coupling member 30 is normally maintained connected to the supporting member 20. When the coupling member 30 received an external force P over a predetermined value (for example, a stretching force from a child), the top split head 31 of the coupling member 30 is forced to pass through the reduced bottom end 25 of the cylindrical through hole 24 of the supporting member 20, and therefore the coupling member 30 and the cord member C are disconnected from the headrail A of the window blind; i.e., the friction force F is designed as the following formula.

load of window blind W<friction force F<external force P

In short, the main feature of the present invention is to set a safety range for the load at the cord member of the window blind so that the cord member is automatically disconnected from the window blind when received a pressure surpassed the set safety range, preventing a hanging accident of the cord member on a child playing the cord member.

Figure 5:
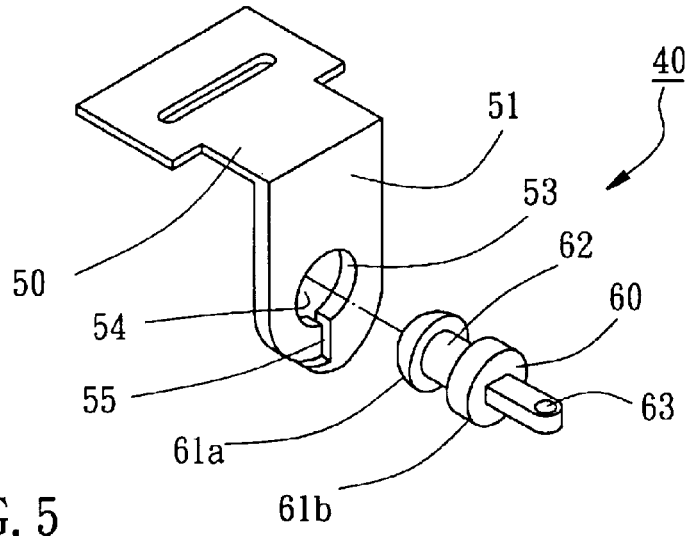
FIG. 5 is an exploded view of a cord member safety connector according to a second preferred embodiment of the present invention.

FIG. 5 shows a cord member safety connector 40 according to the second preferred embodiment of the present invention, which is comprised of a supporting member 50 and a coupling member 60. The supporting member 50 has a downwardly extended flat base 51, and a coupling portion 53 at the base 51 for receiving the coupling member 60. The coupling portion 53 comprises a receiving space, i.e. a circular through hole 54, cut through the front and back sides of the base 51, and an escape opening, i.e. a curved crevice 55 extended from the circular through hole 54 to the periphery of the base 51. The coupling member 60 is a cylindrical member having a round head 61*a* at one end, a tie hole 63 at the other end, a collar 61*b* on the middle around the periphery, and a retaining portion 62 between the round head 61*a* and the collar 61*b*. The diameters of the round head 61*a* and the collar 61*b* are slightly greater than the diameter of the circular through hole 54. The diameter of the retaining portion 62 is smaller than the diameter of the circular through hole 54 but greater than the width of the crevice 55.

Figure 6:
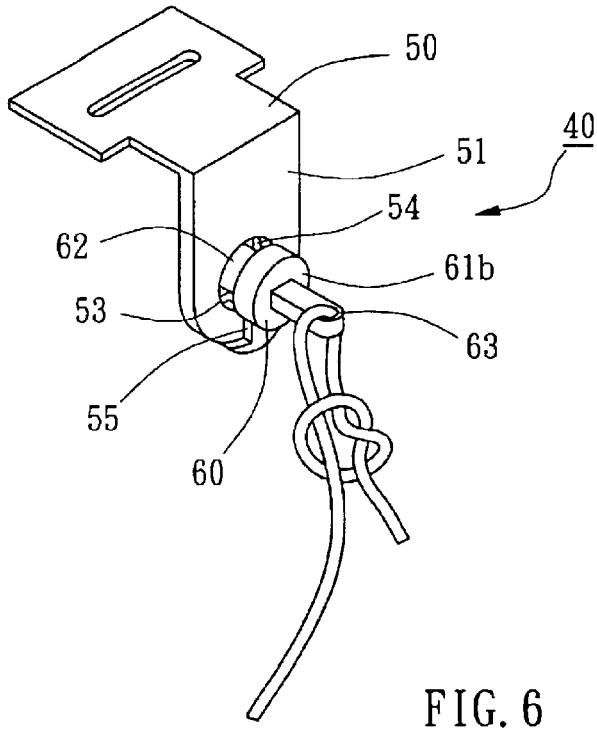
FIG. 6 is a perspective assembly view of the cord member safety connector according to the second preferred embodiment of the present invention.

The connection between the supporting member 50 and the coupling member 60 is outlined hereinafter with reference to FIG. 6. The coupling member 60 is inserted into the circular through hole 54 of the coupling portion 53 of the supporting member 50 by force, keeping the retaining portion 62 suspended in the circular through hole 54 and the round head 61*a* and collar 61*b* respectively stopped at the back and front sides of the base 51. When the cord member 63 at the tie hole 63 of the coupling member 60 excessively stretched by an external force, the crevice 55 is forced to expand, allowing the retaining portion 62 to pass through the crevice 55 to the outside of the coupling portion 53, and therefore the coupling member 60 is disconnected from the supporting member 50.

Figure 7:
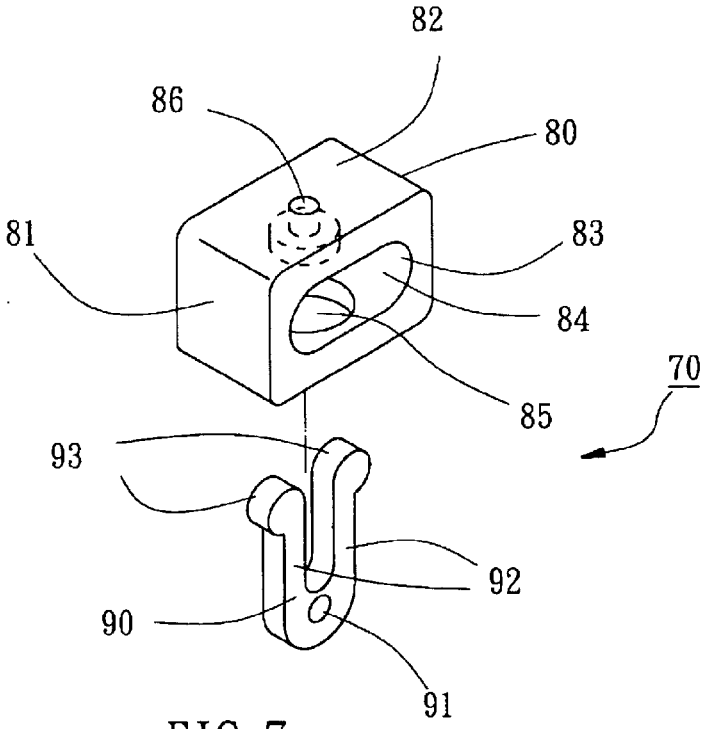
FIG. 7 is an exploded view of a cord member safety connector according to a third preferred embodiment of the present invention.

FIG. 7 shows a cord member safety connector 70 according to the third embodiment of the present invention, which is comprised of a supporting member 80 and a coupling member 90. The supporting member 80 comprises a hollow base 81, a mounting portion 82 at the top side of the hollow base 81, a wire hole 86 in the mounting portion 82 for connection to the window blind, and a coupling portion 83 in the hollow base 81 below the wire hole 86 for receiving the coupling member 90. The coupling portion 83 comprises a receiving space, i.e. a chamber 84, and an escape opening, i.e. a through hole 85 downwardly extended from the chamber 84 to the bottom side of the hollow base 81. The diameter of the through hole 85 is smaller than the diameter of the chamber 84. The coupling member 90 is a substantially U-shaped springy member having a tie hole 91 at the bottom side, two upwardly extended parallel springy arms 92, and two rounded retaining portions 93 respectively formed integral with the distal ends of the springy arms 92.

Figure 8:
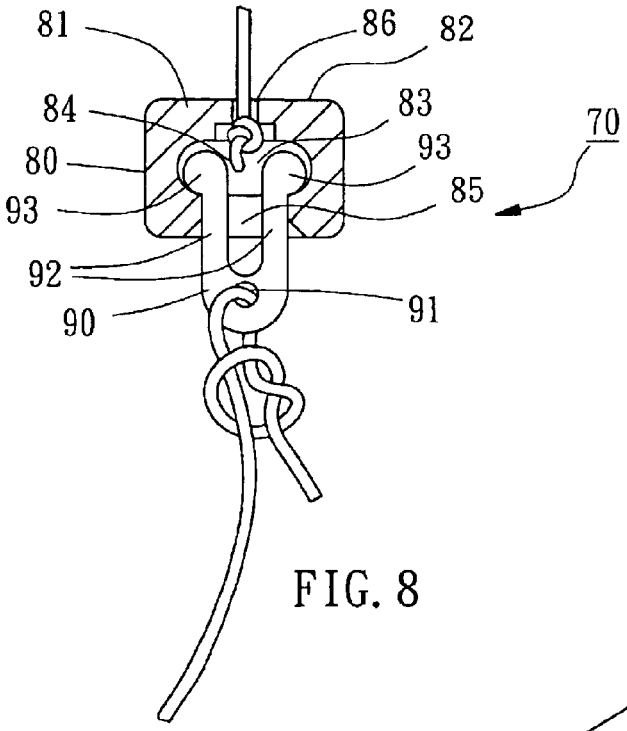
FIG. 8 is a sectional assembly view of the cord member safety connector according to the third preferred embodiment of the present invention.
Figure 9:
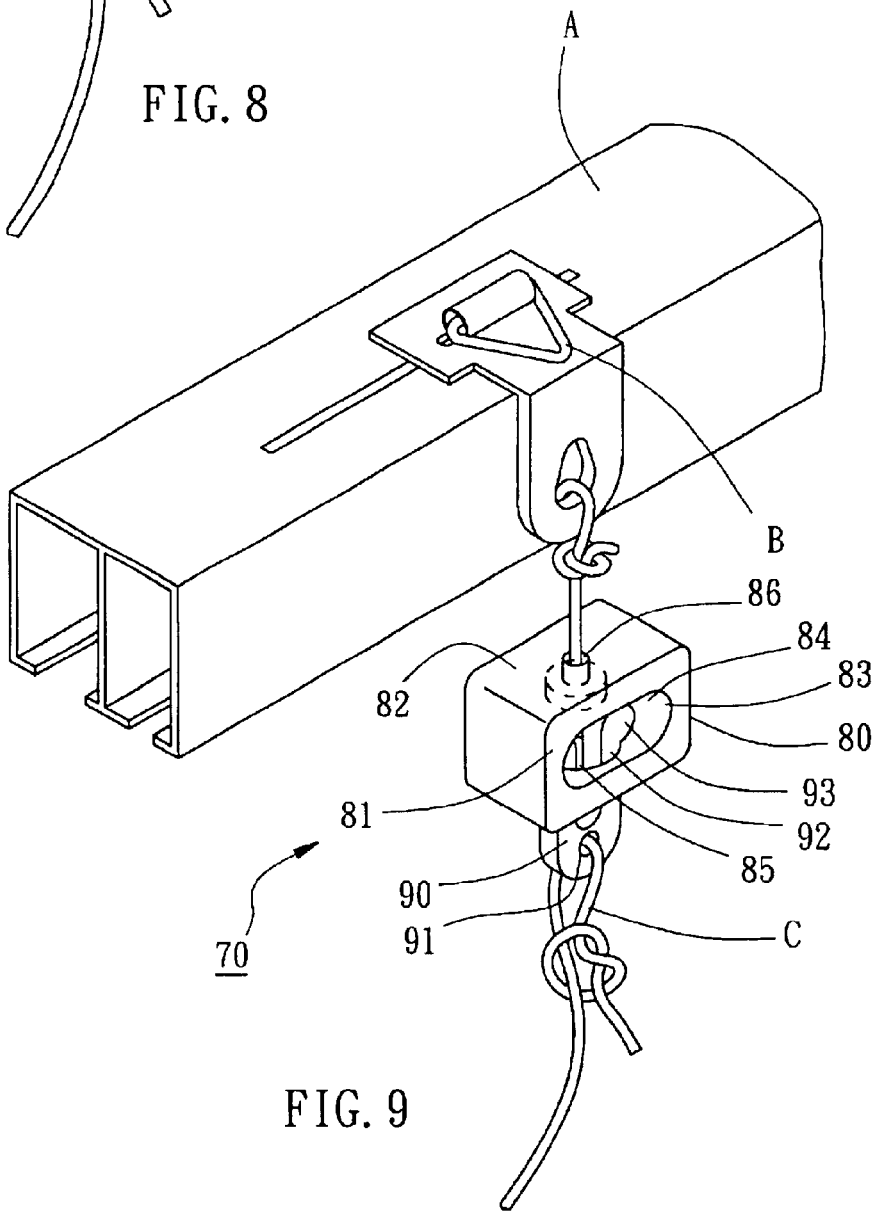
FIG. 9 is a perspective view showing the cord member safety connector of the third preferred embodiment of the present invention installed in the headrail of a window blind.

The installation of the third embodiment of the present invention is outlined hereinafter with reference to FIGS. 8 and 9. After connection of the wire hole 86 to the hanger B at the headrail A of the window blind and connection of a cord member C to the tie hole 91 of the coupling member 90, the springy arms 92 of the coupling member 90 are squeezed inwards to force the retaining portions 93 toward each other for enabling the coupling member 90 to be inserted through the through bole 85 of the coupling portion 83 into the inside of the chamber 84. When released the hand from the coupling member 90 after its insertion through the through hole 85 into the chamber 84, the springy arms 92 automatically return to their former shape due to the effect of their springy material property, and therefore the separated retaining portions 93 are stopped inside the chamber 84 and prohibited from passing through the through hole 85. When the cord member C received an excessively high stretching force, the springy arms 92 are forced toward each other by the peripheral wall of the through hole 85 to force the retaining portions 93 against each other, for enabling the retaining portions 93 to pass through the through hole 85, and therefore the cord member C with the coupling member 90 are disconnected from the supporting member 80 at the window blind.

The aforesaid three embodiments are commonly designed for use in roller blinds. Actually, the invention can be designed to connect the load-carrying cord member or exposed cord member of any of a variety of window blinds. When the load surpassed the set safety range, the cord member is disconnected in time, preventing the occurrence of an accident.

Although particular embodiments of the invention have been described in detail for purposes of illustration, various modifications and enhancements may be made without departing from the spirit and scope of the invention.

Accordingly, the invention is not to be limited except as by the appended claims.

What is claimed is:

1. A connector for connecting a cord member of a window blind to the window blind, said connector comprising:

a supporting member having a base provided with a coupling portion, and a mounting portion, said coupling portion of the base having a receiving space and an escape opening communicated with said receiving space and having a diameter smaller than that of said receiving space;

a coupling member including a compressible retaining portion having a diameter smaller than that of the receiving space and slightly greater than that of the escape opening, and a cord member tie portion for connection of the cord member, said retaining portion of said coupling member being received in said receiving space of said coupling portion of said base and stopped above said escape opening of said coupling portion of said base;

wherein when the cord member, which is connected to the cord member tie portion of said coupling member, received an external force over a predetermined level, said compressible retaining portion of said coupling member is compressed to reduce the diameter thereof and said escape opening of said coupling portion of said base is pressed to increase the diameter thereof for enabling pass of the retaining portion of said coupling member through the escape opening of said coupling portion of said base.

2. The connector as claimed in claim 1, wherein said receiving space of said coupling portion of said base is a cylindrical through hole extended through top and bottom side walls of said base of said supporting member and having a reduced bottom end forming said escape opening; and said coupling member further comprises a body portion connected between said compressible retaining portion and said cord member tie portion, said body portion of said coupling member having a diameter smaller than that of the escaping opening; said compressible retaining portion is an expanded head formed at one end of said body portion.

3. The connector as claimed in claim 2, wherein said expanded head of said compressible retaining portion of said coupling member has a plurality of radial splits.

4. A connector for connecting a cord member of a window blind to the window blind, said connector comprising:

a supporting member having a base provided with a coupling portion, and a mounting portion, said coupling portion of the base having a receiving space and an escape opening communicated with said receiving space and having a diameter smaller than that of said receiving space;

a coupling member including a retaining portion having a diameter smaller than that of the receiving space and slightly greater than that of the escape opening, and a cord member tie portion for connection of the cord member, said retaining portion of said coupling member being received in said receiving space of said coupling portion of said base and stopped above said escape opening of said coupling portion of said base;

wherein when the cord member, which is connected to the cord member tie portion of said coupling member, received an external force over a predetermined level, said escape opening of said coupling portion of said base IS pressed to increase the diameter thereof for enabling pass of the retaining portion of said coupling member through the escape opening of said coupling portion of said base;

wherein said mounting portion of said supporting member has an elongated slot.

5. The connector as claimed in claim 4, wherein said mounting portion of said supporting member is a flat flange extended from one side of said base.

6. The connector as claimed in claim 4, wherein said base is a downwardly extended flat plate member;

said escape opening of said coupling portion of said base of said supporting member is a crevice extended from said receiving space to a periphery of said base;

said coupling member comprises a round head stopped at one side of said base of said supporting member and a collar extended around the periphery thereof and stopped at the other side of said base of said supporting member opposite to said round head member, said round head and said collar respectively having a diameter greater than that of the receiving space.

7. The connector as claimed in claim 6, wherein said crevice is a curved crevice.

8. A connector for connecting a cord member of a window blind to the window blind, said connector comprising:

a supporting member having a base provided with a coupling portion, and a mounting portion, said coupling portion of the base having a receiving space and an escape opening, communicated with said receiving space and having a diameter smaller than that of said receiving space;

a coupling member including a compressible retaining portion having a diameter smaller than that of the receiving space and slightly greater than that of the escape opening, and a cord member tic portion for connection of the cord member, said retaining portion of said coupling member being received in said receiving space of said coupling portion of said base and stopped above said escape opening of said coupling portion of said base;

wherein when the cord member, which is connected to the cord member tie portion of said coupling member, received an external force over a predetermined level, said compressible retaining portion of said coupling member is compressed to reduce the diameter thereof for enabling pass of the retaining portion of said coupling member through the escape opening of said coupling portion of said base.

9. The connector as claimed in claim 8, wherein said coupling member is comprised of two springy arms, said springy arms each having a free end forming said retaining portion, said retaining portions being passable through said escape opening when said springy arms squeezed toward each other.

10. The connector as claimed in claim 8, wherein said mounting portion of said supporting member has a wire hole.

* * * * *